US006195810B1

(12) United States Patent
Minamiyama et al.

(10) Patent No.: US 6,195,810 B1
(45) Date of Patent: Mar. 6, 2001

(54) FLUSHING DEVICE FOR DISPOSING OF HUMAN WASTE WITH IMPROVED DRAINAGE PROPERTIES

(75) Inventors: Takaya Minamiyama; Yasushi Sato; Masato Suzuki; Katsuyuki Okumura; Takahiro Nakamura; Yoshihiro Nishizaki; Yoshiro Matsushita, all of Osaka (JP)

(73) Assignee: Matsushita Electric Works Co., Ltd., Osaka (JP)

( * ) Notice: Subject to any disclaimer, the term of this patent is extended or adjusted under 35 U.S.C. 154(b) by 0 days.

(21) Appl. No.: 09/465,462

(22) Filed: Dec. 17, 1999

(30) Foreign Application Priority Data

Feb. 19, 1999 (JP) ..... 11-041024

(51) Int. Cl.[7] ..... E03D 11/00

(52) U.S. Cl. ..... 4/420; 4/434; 4/421; 4/329; 4/DIG. 16

(58) Field of Search ..... 4/420, 421, 424, 4/431, 434, 435, 436, 438, 439, 441, 329, DIG. 16, DIG. 19

(56) References Cited

U.S. PATENT DOCUMENTS 270,211 * 1/1883 Farthing ..... 4/434
393,109 * 11/1888 Hubert ..... 4/329
5,257,422 * 11/1993 Riiegg ..... 4/DIG. 16
5,446,928 * 9/1995 Daniels ..... 4/434

FOREIGN PATENT DOCUMENTS

1063711 * 3/1967 (GB) ..... 4/424
0042637 * 4/1977 (JP) ..... 4/DIG. 16
404285227 * 10/1992 (JP) ..... 4/421

* cited by examiner

*Primary Examiner*—Henry J Recla
*Assistant Examiner*—Khoa Huynh
(74) *Attorney, Agent, or Firm*—Greenblum & Bernstein, P.L.C.

(57) ABSTRACT

A flushing device for disposing of human waste includes a bowl. A trap section, disposed in a draining path extending from the bowl, has a rear end that pivots between upper and lower positions. A case main body communicates with an external drain pipe and houses the trap section. A driving mechanism moves the trap section between the upper and lower positions. A water supply mechanism supplies water to the bowl. A ring is fitted on the rear end of the trap section. The ring has notches on upper and lower sides such that side edges of the ring have an arcuate shape. The case main body has an arcuate shaped profile that is substantially identical to the arcuate shape of the ring, wherein as the trap section pivots from the upper to lower position, a gap between the arcuate shape of the ring and the upper portion of the rear face inside the case main body is wider than the gap between the arcuate shape of the ring and the lower portion of the rear face inside the case main body.

16 Claims, 18 Drawing Sheets

FLUSHING DEVICE FOR DISPOSING OF HUMAN WASTE WITH IMPROVED DRAINAGE PROPERTIES

BACKGROUND OF THE INVENTION

1. Field of the Invention

The present invention relates to a flushing device for disposing of human waste. More specifically, the present invention relates to a flushing device for disposing of human waste that is easy to assemble and reduces possible clogs.

2. Background and Material Information

Prior art flushing devices for disposing of human waste include a trap section in a drain path extending from a bowl in a case main body that communicates with an external drain pipe. A trap driving mechanism pivots the rear (free) end of the trap section between upper and lower positions. In the upper position, fluid is retained in the bowl. In the lower position, fluid discharges from the bowl along the drain path. A water-supply mechanism supplies water to the bowl. When a flushing switch is activated (i.e., when a user flushes the device), the water-supply mechanism supplies water to the bowl, while the trap driving mechanism moves the rear end of the trap section to the lower position to drain the bowl. The trap driving mechanism then moves the rear end of the trap section to the upper position. The water-supply mechanism turns off after filling the bowl with fresh water.

A drawback of the above prior art device is that the trap section is formed of a soft material, such as rubber. An end of an arm of a pivotal member secured to the rear end of the trap section is made of a hard material that tends to deform the trap section during use. This can block the drainage path and cause waste buildup.

Another drawback of the prior art flushing device is that the opening of the rear end of the trap section has the shape of standard end of a tube. When the trap section opening moves between the upper and lower positions, a gap between the sides of the opening of the rear end of the trap section and the rear face of the inside of the case main becomes larger than the gap between the lowest portion of the opening of the rear end of the trap section and the rear face of the inside of the case. Consequently, waste may flow over the side portions of the rear end of the trap section through this widened gap. That is, before the rear end of the trap section reaches its lower position, waste may flow over the side portions of the rear end of the trap section, staining the sides of the inner face of the case main body. Waste may also cling to the inner face of the case main body, interfering with further discharge of the trap section to the external drain pipe.

Yet another drawback of the prior art is that an arm of the pivotal member must be attached to the case main body so as to freely pivot thereon. A pivot shaft is inserted through a hole formed in the side faces of the case main body. The arm is properly positioned inside the case main body such that the end of the arm is secured to the pivot shaft. This requires a complex structure to install the arm inside the case main body, which increases manufacturing time and costs.

Still another drawback of the above prior art flushing device is that the trap section, which has the shape of a bellow, is fitted and connected to a cylindrical bowl drain outlet formed at the rear end of the bowl. There is a step difference between the tip of the cylindrical drain outlet and the recessed portion of the connecting section that can block the drainage path.

SUMMARY OF THE INVENTION

The present invention provides a flushing device for disposing of human waste that overcomes the above drawbacks of the prior art.

The present invention provides a flushing device for disposing of human waste that includes a trap section inside a case main body to define a draining path extending from a bowl to an external drain. The trap section has a rear (free) end movable between upper and lower positions. A trap driving mechanism pivots the trap section between the upper and lower positions. A water-supply supplies water to the bowl.

A ring is fitted to an inner circumferential section of the rear end of the trap section. The ring has a rear end that is notched from center portions. The respective side edges of the ring have an arcuate shape (from a side view). The ring reinforces the rear end of the trap section to prevent deformation of the trap section, which prevents clogs.

The case main body has a lower portion of its inner rear face that faces the rear end of the ring. This lower portion has an arcuate shape that is substantially identical to the arcuate shape of the ring (in its side view). When the trap section pivots, a gap between the arcuate shape of the ring and the upper portion of the rear face inside the case main body widens, while a gap between the arcuate shape of the ring and the arcuate shape at the lower portion of the rear face inside the case main body narrows. This prevents waste from spilling over the sides of ring 50 during pivotal movement of the trap section.

A pivotal member pivotally mounted to the case main body is attached to the outer circumferential face of the trap section such that the rear end of the trap section is sandwiched between the pivotal member and the ring. This allows the ring to be easily and firmly attached to the rear end of the trap section.

Moreover, it is preferable to install a ring positioning section at the rear end of the trap section, and a positioning-use section at the ring, such that they engage. This arrangement makes it possible to attach the ring to the trap section in an appropriate positional relationship.

It is also preferable that the pivotal member includes a pair of pivotal half members having an identical shape. Each pivotal half member includes a pivotal arm having a first end pivotally mounted on case main body so as to freely pivot thereon, and a second end having an integral semicircular section. A pair of the semicircular sections secure to each other around the outer circumferential section of the rear end of the trap section. This simplifies attaching the pivotal member to the trap section. The pivotal half members can also preferably be molded using a common metal mold.

It is also preferable that bearing groove sections, each having an upper opening, are formed in inner faces on the respective right and left side portions of the case main body. A side opening section, which has openings upward and sidewards, and which is narrower than the groove section, is formed on the side of each bearing groove section. A pivot shaft member, which projects sideways, is formed on one end of the pivotal arm. A flange is formed on the projecting end of the pivot shaft member. The flange fits to the bearing groove section from above so as to freely pivot thereon, and the pivot shaft member fits to the inside of the side opening section so as to freely pivot therein. With this arrangement, the pivotal member is inserted into the case main body from above; the flange is fitted to the bearing groove section from above so as to freely pivot thereon; and the pivot shaft member is fitted to the inside of the side opening section so as to freely pivot therein.

Moreover, it is preferable to provide a draining notched section to drain water remaining inside the bearing groove section at the lower end of the side opening section. Even if waste water flows into the bearing groove section, it can drain through the draining notched section. This prevents waste water from building up and hardening within the bearing groove section that could otherwise hinder pivotal movement of the pivotal member.

Furthermore, it is preferable to chamfer the corner portions defined by the side faces and the rear face of the case main body. This avoids waste from depositing at the corner portions.

It is also preferable to form the trap section into a bellows shape, including alternating protrusions and recesses that continue alternately. The protrusion at the front end of the trap section is extended axially to form a cylindrically shaped connection section. The recess immediately adjacent this connecting section has a wider radius than the other recesses to define a widened recess. The cylindrical connection section of the trap section is fitted to a bowl drain outlet such that the inner circumferential surface of the cylindrical bowl drain outlet is substantially flush with the widened recess. This eliminates a step difference between the tip of the cylindrical bowl drain outlet, which prevents waste build up in this area.

In another aspect of the present invention, a flushing device for disposing of human waste is provided. The flushing device includes a bowl, a trap section disposed in a draining path extending from bowl and having a rear end that pivots between upper and lower positions, and a case main body that communicates with an external drain pipe and houses trap section. A driving mechanism is provided that moves the trap section between upper and lower positions. The flushing device also includes a water supply mechanism that supplies water to the bowl, a ring fitted on the rear end of the trap section, which ring has notches on upper and lower sides such that side edges of the ring have an arcuate shape. The case main body has an arcuate shaped profile that is substantially identical to the arcuate shape of ring, wherein as the trap section pivots from the upper position to the lower position, a gap between the arcuate shape of the ring and the upper portion of the rear face inside the case main body is larger than a gap between the arcuate shape of the ring and a lower portion of the rear face inside the case main body.

In a further aspect of the present invention, the driving mechanism of the flushing device for disposing of human waste includes a pivotal member, and the pivotal member is attached to the outer circumferential face of the trap section so that the rear end of the trap section is between the pivotal member and the ring. Additionally, a ring positioning section may be formed on the rear end of the trap section while a positioning-use section is formed in the ring, such that the ring positioning section and the positioning-use section engage with each other.

Furthermore, the pivotal member may include a pair of pivotal half members having a substantially identical shape, each pivotal half member including a pivotal arm having a first end pivotally mounted on the case main body, and a second end with an integral semicircular section, wherein the semi-circular section of each of pair of half members connects to each other around the outer circumferential section of the rear end of the trap section.

In a further aspect of the present invention, the flushing device for disposing of human waste further includes bearing groove sections in inner faces of respective right and left side portions of the case main body, each groove section having an upper opening, and a side opening section having openings upward and sidewards, and narrower than a respective groove section, formed on a side of each of the bearing groove sections. A pivot shaft, projecting sideways, is formed on one side of the pivotal arm, and a flange is formed on the pivot shaft. The flange is pivotally mounted on a respective one of the bearing groove sections, and the pivot shaft is pivotally mounted on the side opening section.

Additionally, the flushing device for disposing of human waste further includes draining notched sections in each side opening section for draining water remaining inside the bearing groove sections at a lower end of the side opening section, and corner sections of case main body, defined by side faces and rear face of case main body, may be chamfered to prevent the accumulation of waste material at the corner sections.

According to a further aspect of the present invention, the trap section is bellows-shaped, including alternating protrusions and recesses. A fowardmost one of the protrusions is axially larger than other ones of the protrusions to define a cylindrical connecting section. A fowardmost one of the recesses behind the connecting section has a larger radius than other ones of the recesses, and the cylindrical connecting section of the trap section is fitted to a cylindrical bowl drain outlet at the rear end of the bowl so that the inner circumferential surface of the cylindrical bowl drain outlet is substantially flush with the widened recess.

In another aspect of the present invention, a flushing device for disposing of human waste includes a bowl, a trap section disposed in a draining path extending from bowl and having a rear end that pivots between upper and lower positions, and a case main body that communicates with an external drain pipe and houses the trap section. The flushing device also includes a water supply mechanism that supplies water to the bowl, and a driving mechanism that moves the trap section between the upper and lower positions.

The driving mechanism includes first and second bearing grooves on the case main body, first and second arms, each having a projecting shaft at a first end pivotally supported in the first and second bearing grooves, respectively, with semicircular portions extending from a second end that join to encircle the rear end of trap, and the projecting shaft of the first arm has a hole with a non-circular cross section. The driving mechanism also includes a pivot element having a plate and a protrusion that mates with the hole, the plate having a central hole and a plurality of peripheral holes, and an engaging element is provided to engage the plate at the central hole and at least some of plurality of peripheral holes. Addition, the driving mechanism includes a motor that rotatably drives the engaging element, which rotatably drives the plate, which rotatably drives the first and second arms, to move the rear end of the trap between upper and lower positions.

According to other aspects of the invention, the flushing device further includes a ring mounted on the rear end of the trap, the ring having notches at top and bottom portions thereof to define side portions, such that waste overflow in the trap will flow over at least one of the top and bottom portions before the side portions. Additionally, the engaging element may engage two of plurality of peripheral holes.

In further aspects of the present invention, the flushing device may further include an enclosure having an opening, the motor, the plate of the pivot element, and the engaging element are disposed outside of enclosure, and the first and second arms are disposed inside enclosure, and the projection of the pivoting element passes through opening. The flushing device may further include a pivotal block on which the motor and the engaging element are mounted.

In other aspects of the flushing device of the present invention, wires are provided for the motor, the wires extend from the motor, around a base of the pivoting block, and up an opposing side of the pivoting block. The flushing device may further include a detection member extending from the plate, and at least one detection apparatus that detects a position of the rear end of the trap based on a position of the detection member.

In yet another aspect of the present invention, the flushing device for disposing of human waste includes a bowl having a bowl drain outlet, and a trap section disposed in a draining path extending from bowl, the trap section having a rear end that pivots between upper and lower positions. A case main body is provided that communicates with an external drain pipe and houses the trap section, and a water supply mechanism supplies water to bowl.

The flushing device includes a driving mechanism that moves the trap section between the upper and lower positions. The trap section includes a plurality of alternative protrusions and recesses to define a bellows shape, an upstream most one of the protrusions being axially longer than others of the plurality of protrusions to define a connecting section that connects with the bowl drain outlet, and an upstream most one of the recesses have an inner diameter that is substantially identical to an inner diameter of the bowl drain outlet to define a substantially flush connection therebetween.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of certain embodiments of the present invention, in which like numerals represent like elements throughout the several views of the drawings, and wherein:

FIG. 10(*b*) is a horizontal cross-sectional view of the rear portion of the case main body;

FIG. 17(*b*) is a rear view of the base plate;

DETAILED DESCRIPTION OF THE PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Referring to the attached drawings, the following description will discuss embodiments of the present invention.

Figure 3:
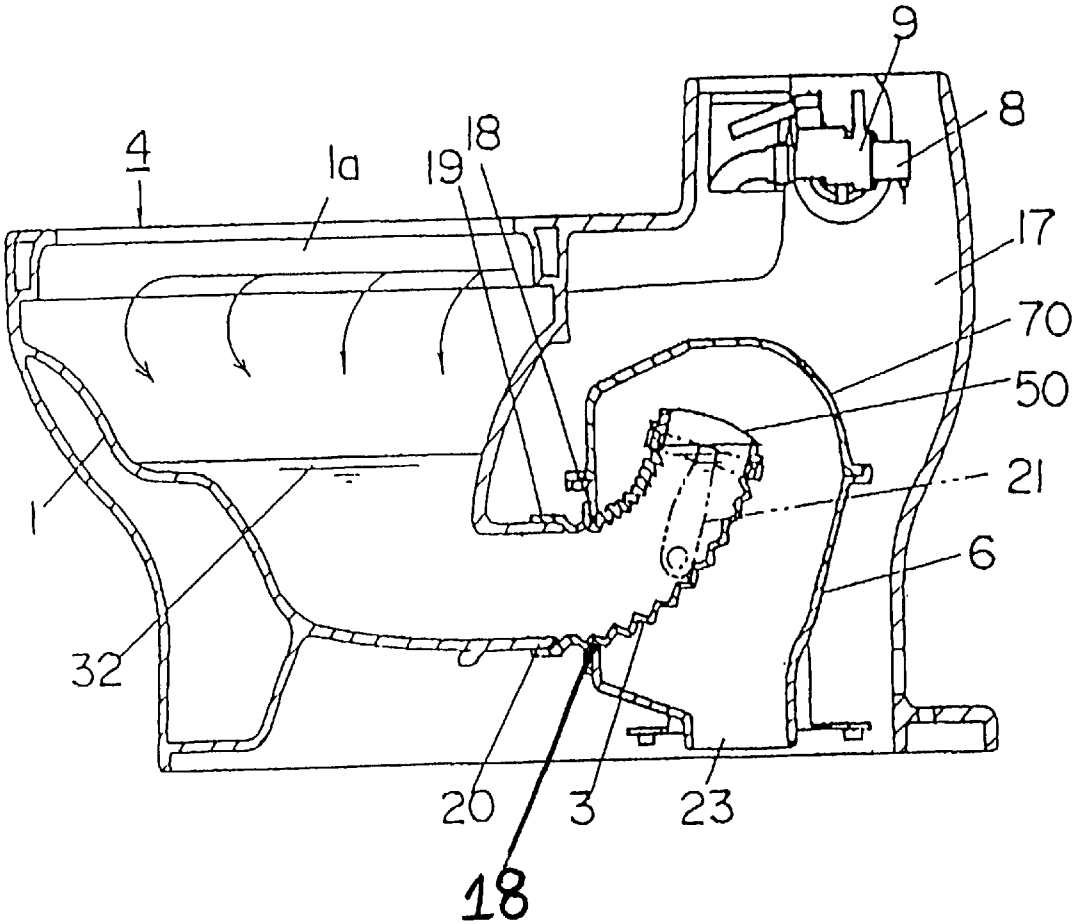
FIG. 3 is a cross-sectional view that shows a flushing operation of the above-mentioned preferred embodiment in which water is supplied to a bowl, and the rear end of a trap section is in the upper position.
Figure 4:
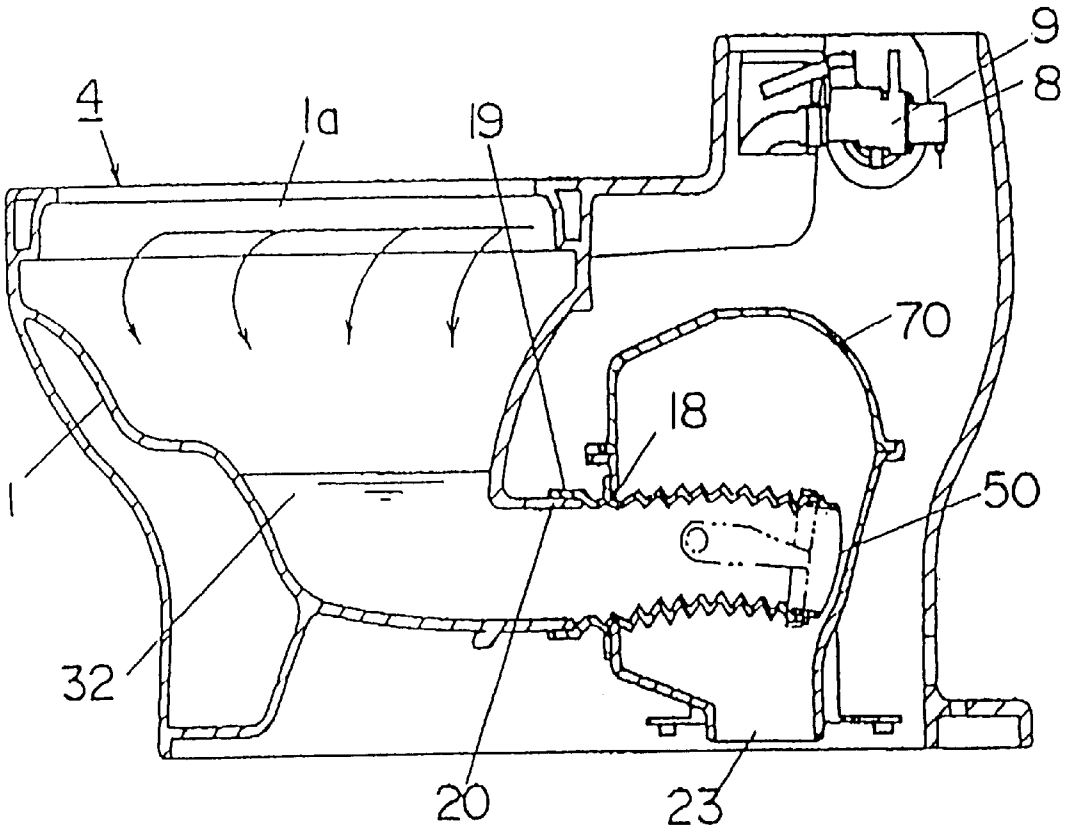
FIG. 4 is a cross-sectional view that shows the flushing operation of the above-mentioned preferred embodiment in which the rear end of the trap section is between the upper and lower positions.
Figure 5:
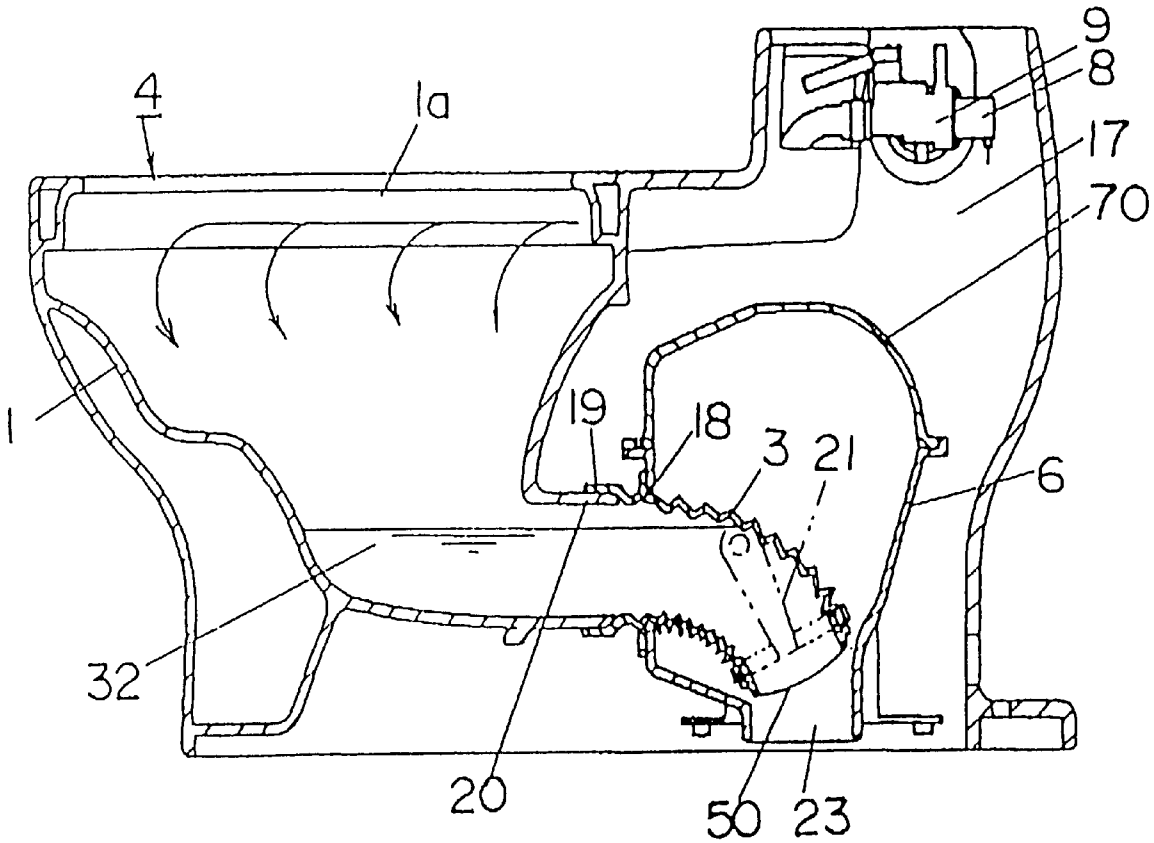
FIG. 5 is a cross-sectional view that shows the flushing operation of the above-mentioned embodiment in which waste discharges and the rear end of the trap section is in the lower position.

FIGS. 1–6 show a flushing device 4 for disposing of human waste. A bowl 1 has a top opening 1*a* for receiving waste. A housing space 17 inside the rear portion of flushing device 4 houses a case main body 6. A securing hole 18 is formed in a forward wall of case main body 6. To this securing hole 18 is inserted and attached a pivotable trap section 3 movable between an upper position (FIG. 3) and a lower position (FIG. 5). Most of trap section 3 is placed inside case main body 6. A connecting section 19 of the front end of the trap section 3 protrudes from the case main body 6 to connect to a bowl drain outlet 20 in the lower rear end of the bowl 1. A drain hole 23 connects to the lower section of case main body 6. An external drain pipe 5 (FIG. 2) connects to drain hole 23. The bowl drain outlet 20, the trap section 3, the case main body 6, and the external drain pipe 5, define a drain path 2 that extends from the bowl 1.

A rear end of trap section 3 is driven by a trap driving mechanism 7 (FIG. 6), which includes a motor 22 installed outside main body case 6. Trap section 3 is made of a soft material, such as rubber, and has a bellow shape. A pivotal member 21, pivotally mounted on case main body 6, connects to the rear end of the trap section 3. Pivotal member 21 is also driven by motor 22. When motor 22 rotates in one direction, the rear end of the trap section 3 pivots to the lower position. When the motor 22 rotates in the reverse direction, the rear end of the trap section 3 pivots to the upper position.

A device case 24 is mounted on the top of the rear portion of flushing device 4. A water supply path 8 that supplies water to bowl 1 is installed inside device case 24. This water supply path 8 has a first end (not shown) that communicates with a rim section for water passage that is formed at the edge of the upper opening of bowl 1, and a second end that connects to a water supply pipe (not shown). In the middle of water supply path 8, a water-supply mechanism 9, preferably a water supply solenoid valve to open and close the water supply path 8, is installed.

A seat 33 and a lid 34 are pivotally attached to the device case 24. A private-part rinsing device (not shown) is installed inside device case 24, and may include a buttock rinsing nozzle.

Figure 6:
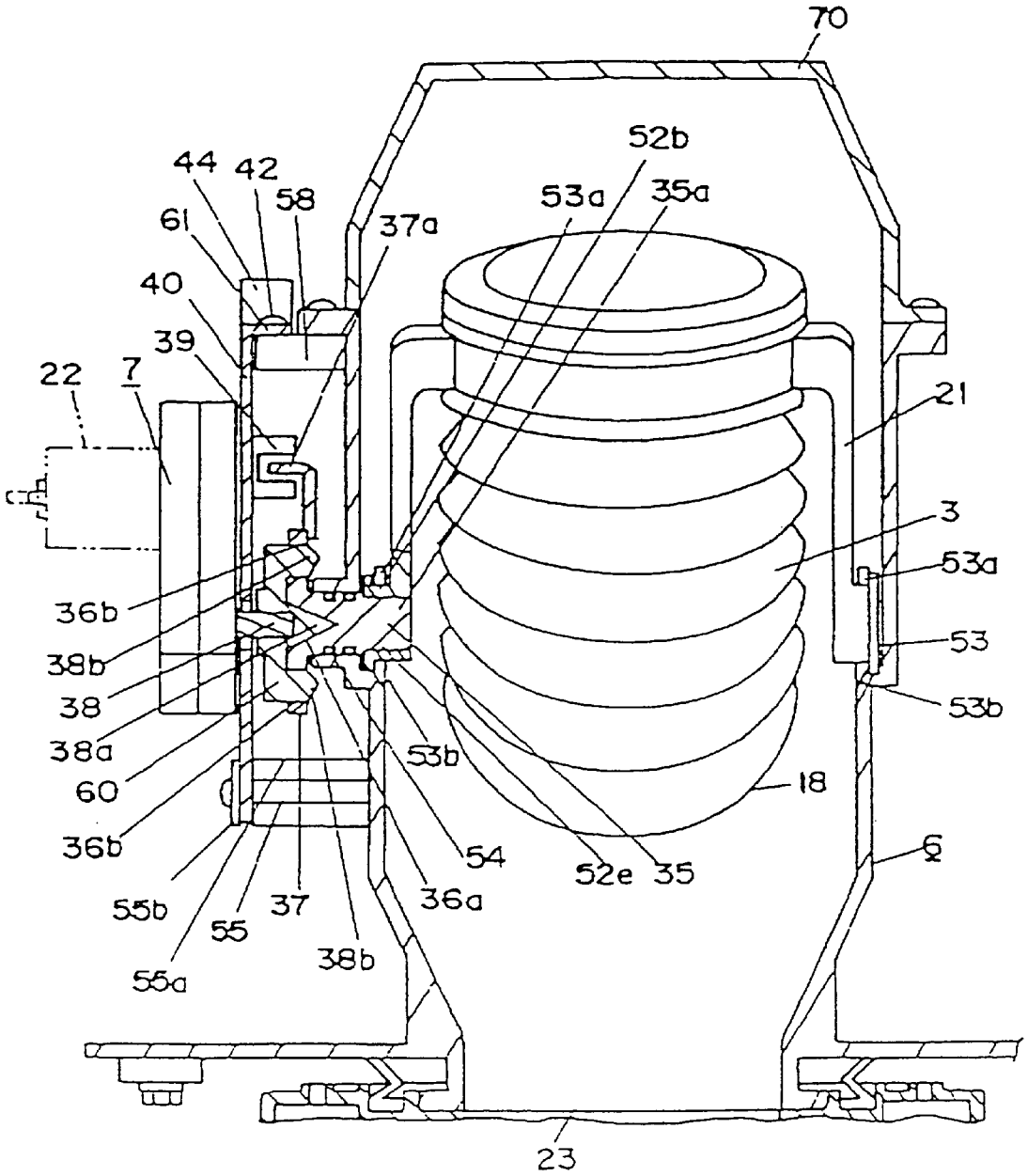
FIG. 6 is a cross-sectional view of the rear face of a case main body of the above-mentioned preferred embodiment.
Figure 7:
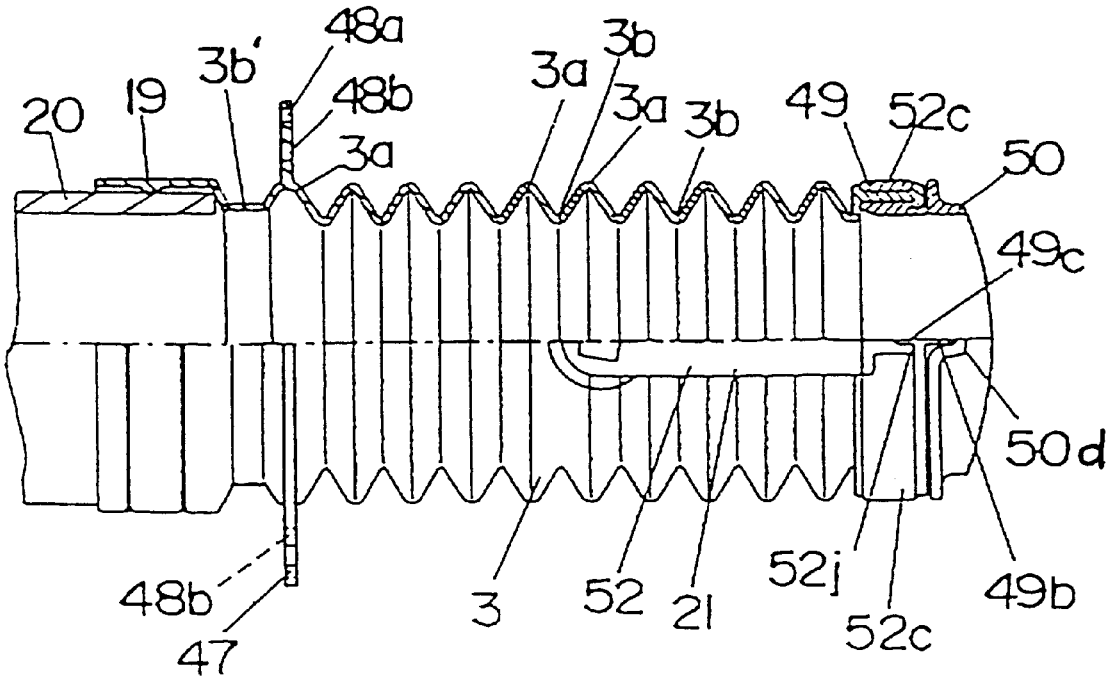
FIG. 7 is a partial cross-sectional view of the trap section.
Figure 8:
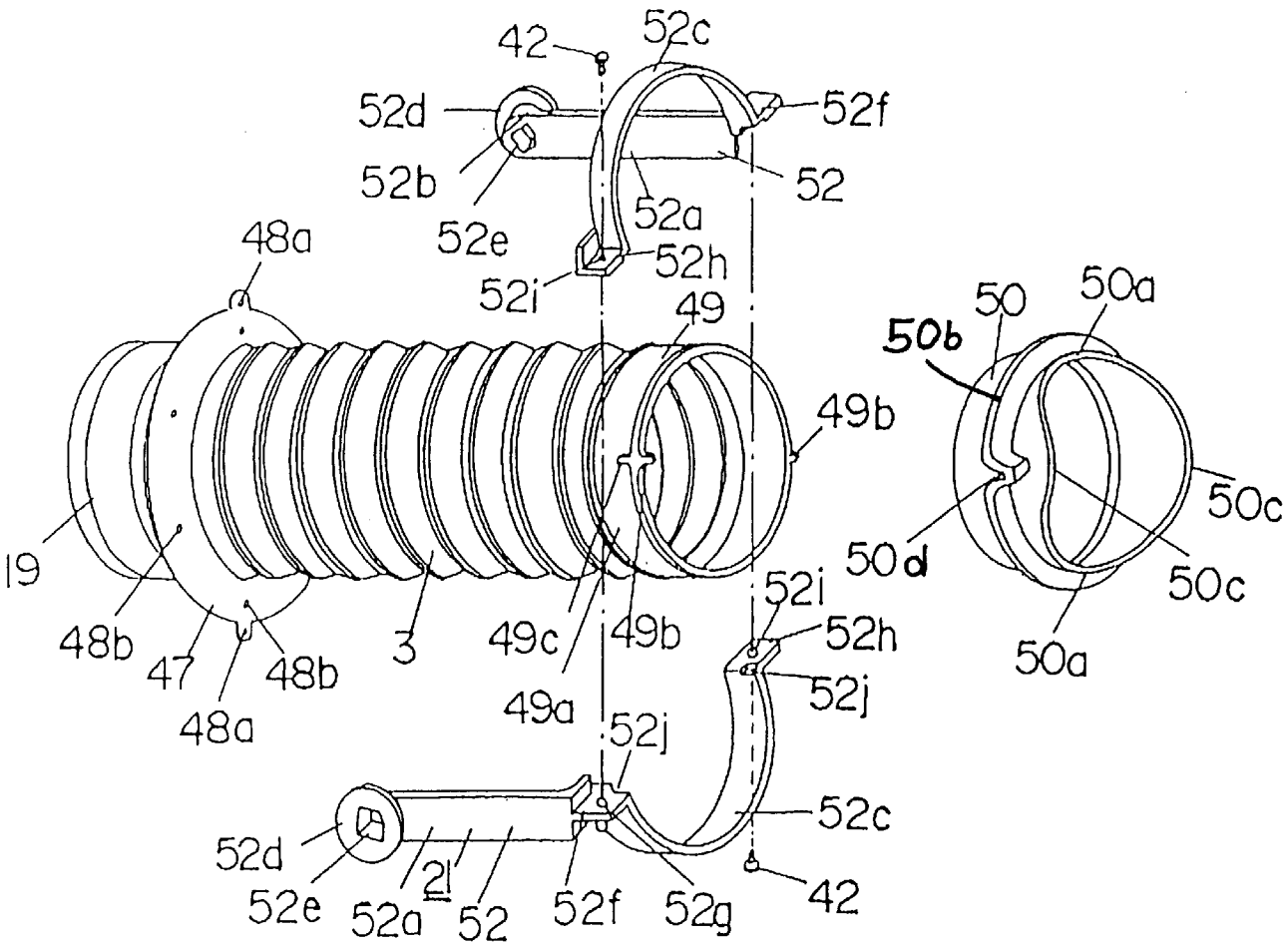
FIG. 8 is an exploded perspective view of the trap section, a ring and a pivotal member.

Referring now to FIGS. 6–8, trap section 3 has a substantially cylindrical bellows shape, and is made of soft material, such as natural or synthetic rubber, neoprene, polyurethane, or any suitable material. The bellows shape defines protrusions 3*a* and recesses 3*b* that alternate in the axial direction. A protrusion 3*a* at the front (upstream) end of the trap section 3 extends axially to define a connecting section 19 having a cylindrical shape. A recess 3*b*' immediately downstream from section 19 has a slightly wider diameter than the other recesses 3*b*. A securing flange section 47 extends from the outer circumferential portion of a protrusion 3*a* immediately downstream of recess 3*b*'. Positioning holes 48*a* and insertion holes 48*b* are formed in the securing flange section 47.

An axial extension of the width of a protrusion 3*a* at the rear end of trap section 3 defines a connecting cylinder section 49 having an outer circumferential face formed as a tube-shaped recess 49*a*. Ring positioning sections 49*b* and 49*c*, which have protruding shapes, extend from connecting cylinder section 49.

Trap section 3 passes through fixing hole 18. The positioning holes 48*a* are mounted on positioning protrusions 6*a* (FIG. 10(*a*)) placed around fixing hole 18 to position the securing flange section 47 with respect to the case main body 6. Flange section 47 secures to case main body 18 by inserting several threaded fasteners 42 (e.g., a screw or bolt) through insertion holes 48*b* into tapped holes around fixing hole 18 of case main body 6.

As seen in FIG. 8, a ring 50, made of hard material, such as metal, polyvinyl chloride, or a similar suitable material, has a positioning-use section 50*b* with notched section 50*d* that mates with ring positioning section 49*b* to place ring 50 in a predetermined positional relationship with respect to connecting cylinder section 49. The rear end of ring 50 is gradually notched to form notched sections 50*a* adjacent side edges 50*c*, which have an arcuate shape when viewed from the side.

When securing flange section 47 aligns with trap section 3 as described above with respect to case main body 6, ring positioning section 49*b* and positioning use section 50*b* align in a horizontal plane when in the position shown in FIG. 4. As a result, notched sections 50*a* align as the top and bottom of ring 50 (relative to device 4), while sections 50*c* align as side sections. In the embodiment shown in FIG. 8, positioning use sections formed in the center portions on the respective sides of section 49 have a longer protrusion at the rear end of ring 50; therefore, ring positioning sections 49*b* are located in the center portions on the respective sides in the condition where trap section 50 is positioned and attached to case main body 6. The rear portion of ring 50 inserts inside connecting cylinder section 49 to provide internal support thereto.

A pivotal member 21 is pivotally mounted on case main body 6 and located at ring-shaped recess 49*a* on the outer circumferential face of connecting cylinder section 49 at the rear end of trap section 3. As shown in FIG. 8, the pivotal member 21 includes a pair of identical pivotal half members 52. Each pivotal half member 52 includes a first end from which a pivot shaft member 52*b* projects sideways, and second end that supports a semicircular section 52*c* that projects in a direction opposite to the protruding direction of pivot shaft member 52*b*.

A flange 52*d* is formed on the outer end of pivot shaft member 52*b*, and a shaft hole 52*e*, having a non-circular cross-section, is formed in pivot shaft member 52*b*. A base-side receiving section 52*f* with a tapped hole 52*g* is formed on a first end of semicircular section 52*c*, while a topside contact section 52*h* with a tapped hole 52*i* is formed in the opposite end of semicircular section 52*c*. Positioning-use recesses 52*j* are formed in receiving section 52*f* and contact section 52*h*.

The pair of semicircular sections 52*c* of pivotal half members 52 fit around cylinder section 49. Ring positioning sections 49*c* are held in positioning-use recesses 52*j*. The topside contact section 52*h* of the first pivotal half member 52 aligns with the base-side receiving section 52*f* of the second pivotal half member 52, while the topside contact section 52*h* of the second pivotal half member 52 aligns with the base-side receiving section 52*f* of the first pivotal half member 52. A threaded fastener 42 inserted through each hole 52*i* engages each tapped hole 52*g* to secure the pair of pivotal half members 52 to the rear end of trap section 3, such that connecting cylinder section 49 presses against the hard ring 50 by the pair of semicircular sections 52*c*. Thus, the ring 50 will not slip off the connecting cylinder 40. Moreover, positioning sections 52*j* are respectively fitted to the pivotal member positioning sections 49*c* such that the pair of the pivotal half members 52 are attached to trap section 3 in a properly positioned condition. When trap section 3 is in a horizontal position, the pivotal arm 52*a* of each pivotal half member 52 is also horizontal.

Figure 9:
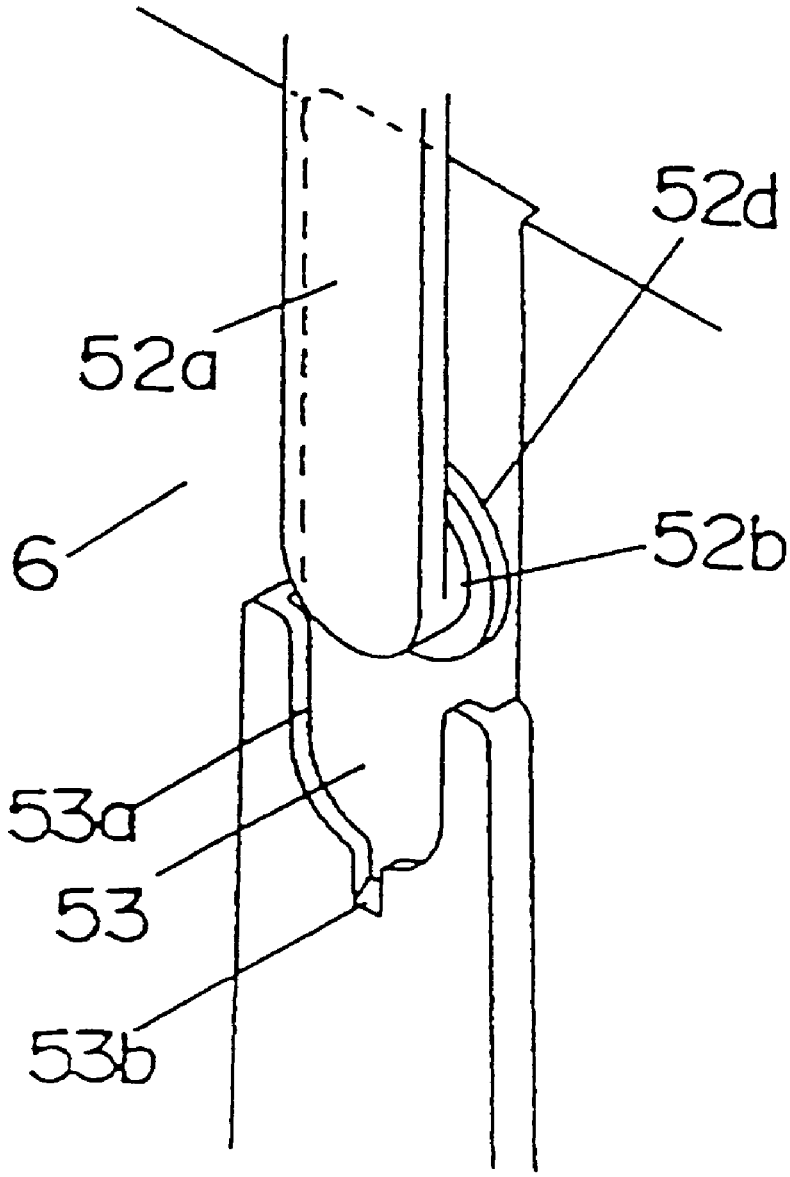
FIG. 9 is a perspective view of the pivotal member being inserted from above to the case main body.

Referring now to FIG. 9, bearing groove sections 53 are formed in the inner surfaces on the respective right and left sides of case main body 6. Each bearing groove section 53 has a U-shape with an upward opening and a side opening section 53*a* on each of the side faces. The side opening section 53*a* is narrower than the groove of the bearing groove section 53. At the lower end of side opening section 53*a*, a draining notch section 53*b* that drains water from inside the groove is formed. The lateral width of the groove of bearing groove section 53 is large enough to receive flange 52*d* such that it can pivot therein. The lateral width of a side opening section 53*a* is smaller than a diameter of the flange 52*d* and larger than a width of pivot shaft member 52*b* so that pivot shaft member 52*b* can rotate inside side opening section 53*a*. Moreover, with respect to bearing groove sections 53 on the right and left sides of case main body 6, a shaft hole 54 is formed at a portion of case main body 6 inside the groove of one of bearing groove sections 53, as seen in FIG. 6.

The flange 52*d* fits into each of the bearing groove sections 53 from above as illustrated in FIG. 9, with pivot shaft member 52*b* fitting into the side opening section 53*a* from above. Thus, pivotal member 21 attaches to the rear end of the trap section 3 so as to freely pivot thereon.

Figure 11:
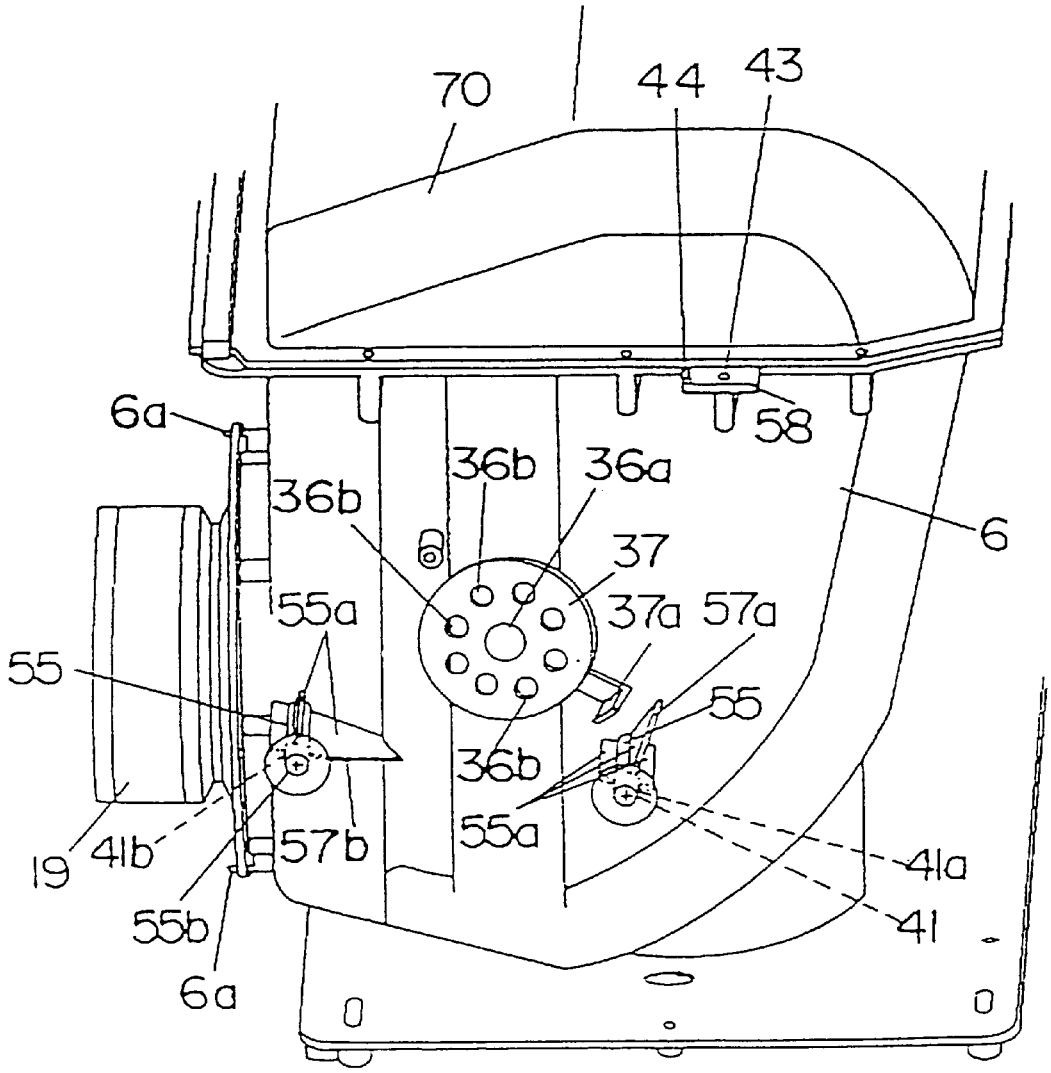
FIG. 11 is a perspective view of a rotation plate attached to the case main body.
Figure 18:
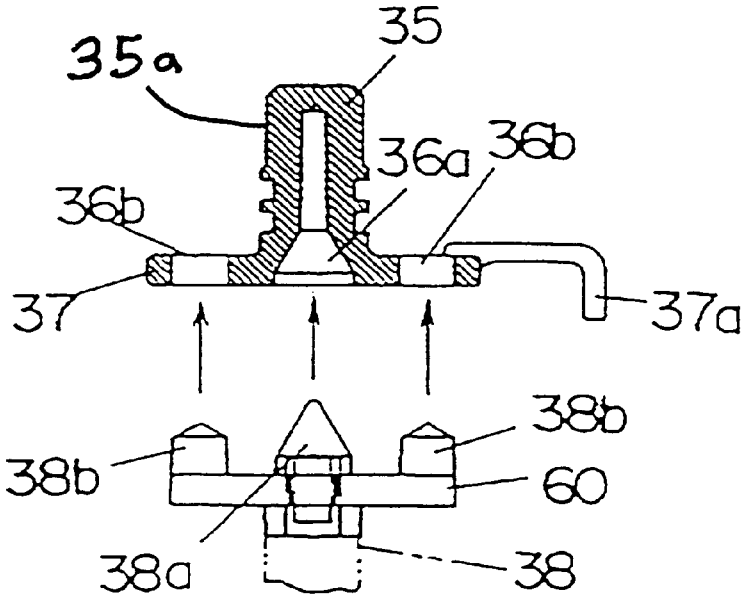
FIG. 18 shows a central stopping section and sub-stopping sections engaged with a central stopping hole and sub-stopping holes and stopped therein respectively.
Figure 19:
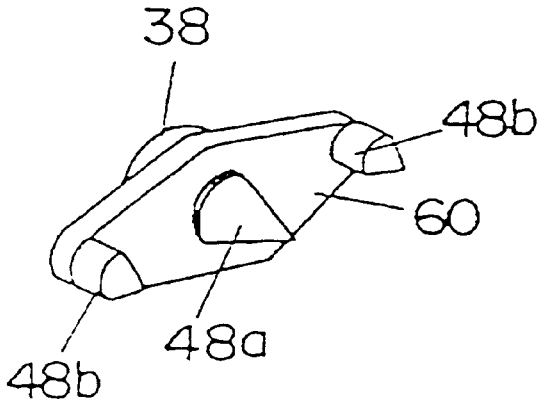
FIG. 19 is a perspective view showing a pivotal block having the central stopping section and the sub-stopping sections.
Figure 20:
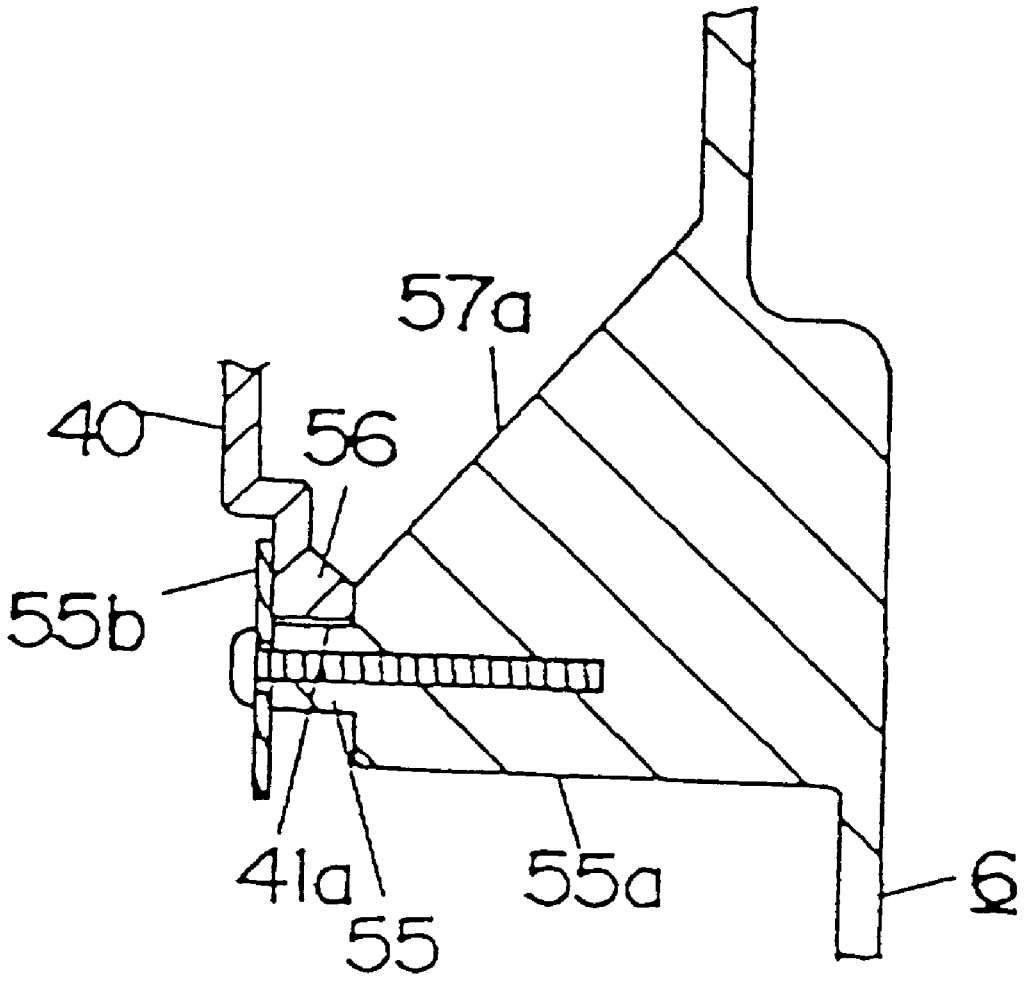
FIG. 20 is a cross-sectional view of a condition in which the stopping section formed at the lower portion of the base plate is engaged with the base plate engaging section formed at the lower portion of the case main body.

As shown in FIGS. 6, 11, and 18, a pivot shaft 35 has a first end with a positioning fit shaft 35*a* having a non-circular cross-section that mates with the non-circular cross-section of shaft hole 52*e*, and a second end with a round rotation plate 37. A central engaging hole 36*a* is formed in the end of pivot shaft 35 adjacent rotation plate 37. A plurality of sub-engaging holes 36*b* are positioned equidistantly around central engaging hole 36*a* in rotation plate 37. A protruding member 37*a* protrudes from the outer circumferential end of the rotation plate 37.

Pivot shaft 35 is mounted pivotally in shaft hole 54 so as to freely pivot therein from outside case main body 6. The positioning fit shaft 35*a* fits firmly into the shaft hole 54 so that the pivot shaft 35 connects to pivotal member 21 in a predetermined positional relationship. Thus, rotation plate 37 and protruding member 37*a* are located outside the case main body 6 with the pivot shaft 35 being attached thereto (see FIGS. 6 and 11). Moreover, a case upper lid 70 is attached to the upper portion of the case main body 6.

As illustrated in FIG. 11, base plate engaging sections 41 are installed in the lower section of the side face of case main body 6 on the side having a shaft hole 54.

Base plate engaging sections 41 are respectively installed on the diagonally front lower side and the diagonally rear lower side of case main body 6. Each base plate engaging sections 41 has ribs 55*a* along a pin portion 55. The tip of each rib 55*a* is slightly recessed from the tip of pin portion 55. A disc shaped stopping plate 55*b* is mounted on the tip of pin portion 55 so that a stopping section 56 formed in a lower section of a base plate 40 (see FIG. 14, which will be described later) is engaged and stopped by a recess between the stopping plate 55*b* of the tip of pin portion 55 and a rib 55*a*.

Figure 12:
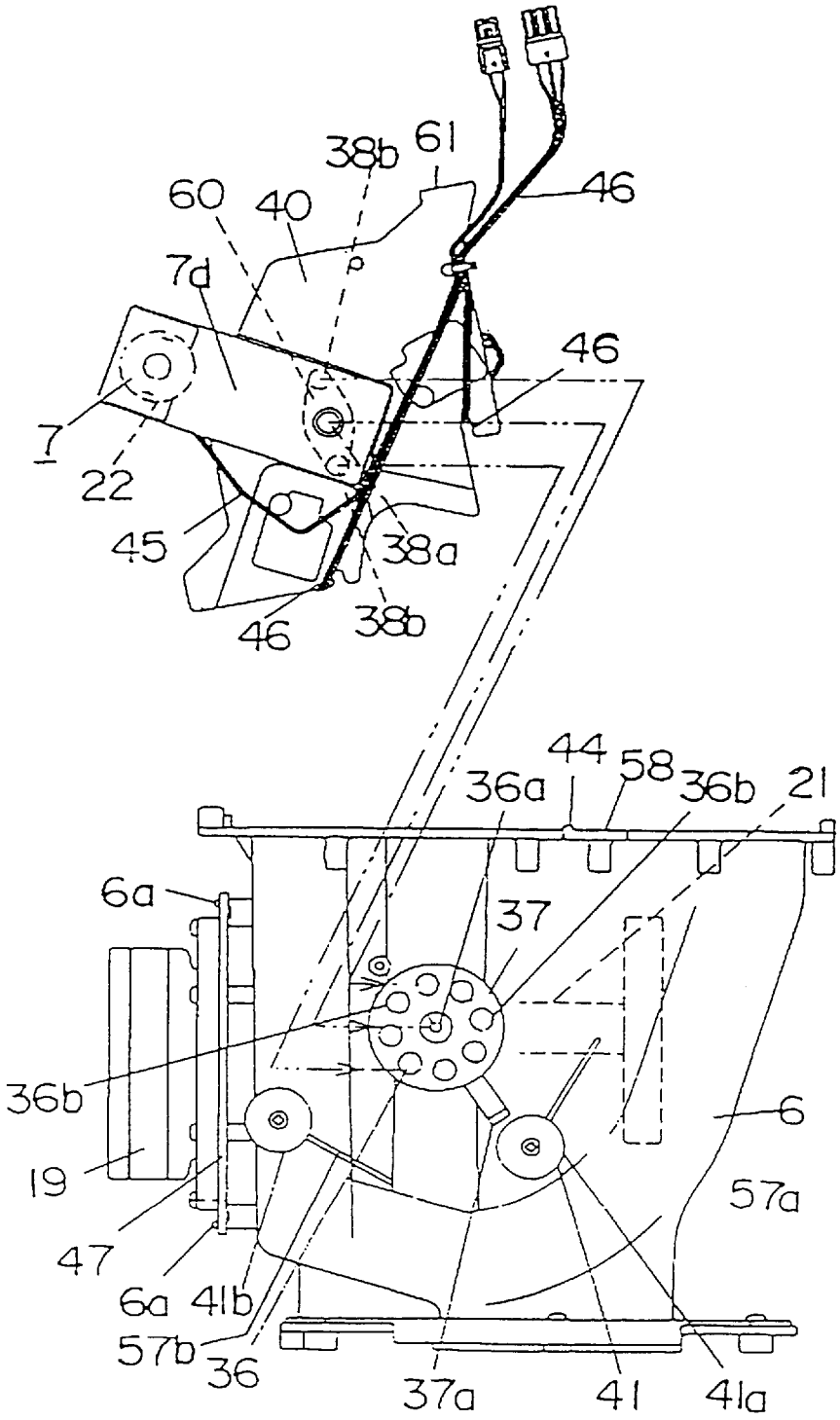
FIG. 12 shows a first sequence for attaching a base plate to the case main body.
Figure 13:
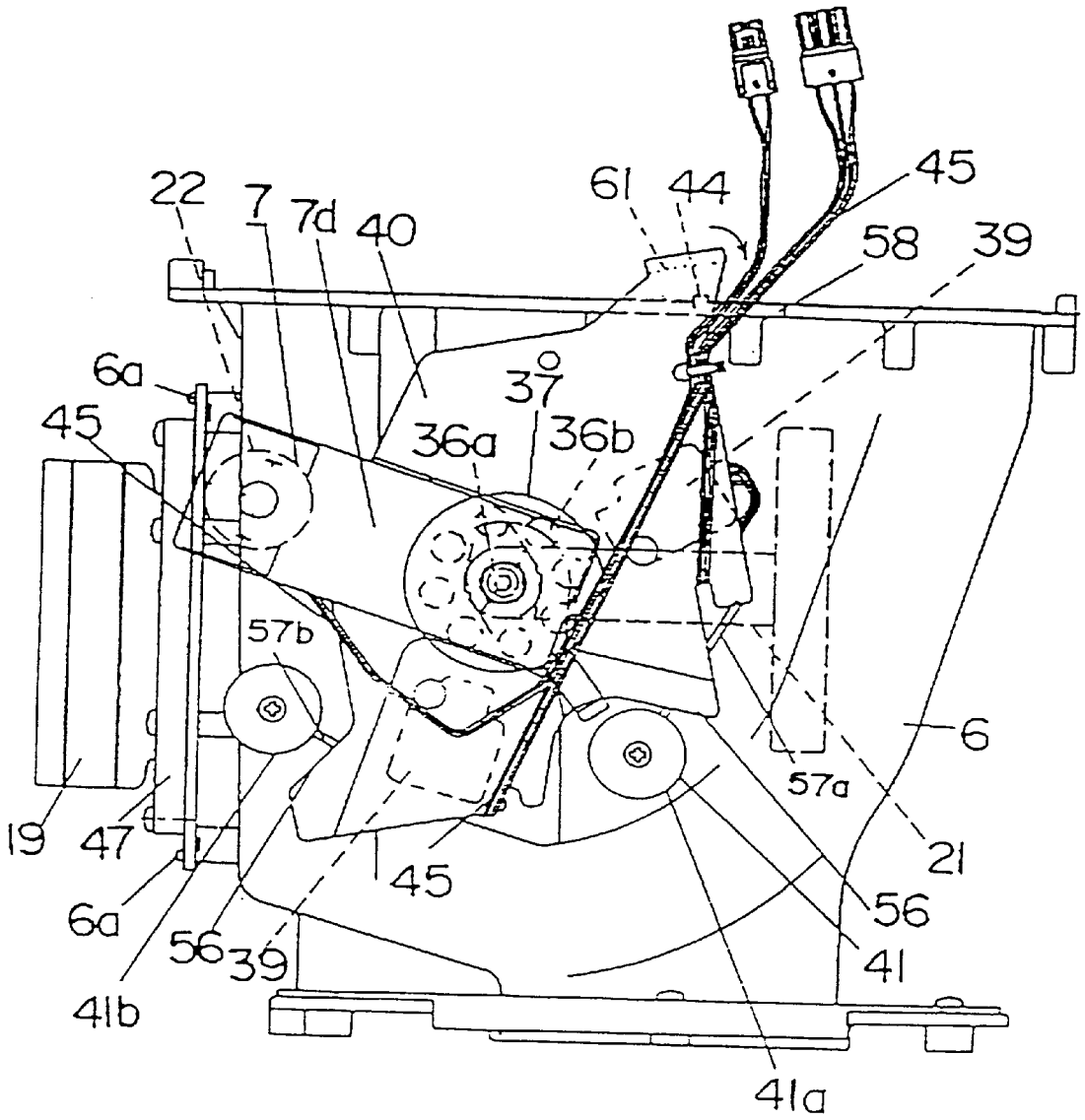
FIG. 13 shows a second sequence for attaching the base plate to the case main body.
Figure 14:
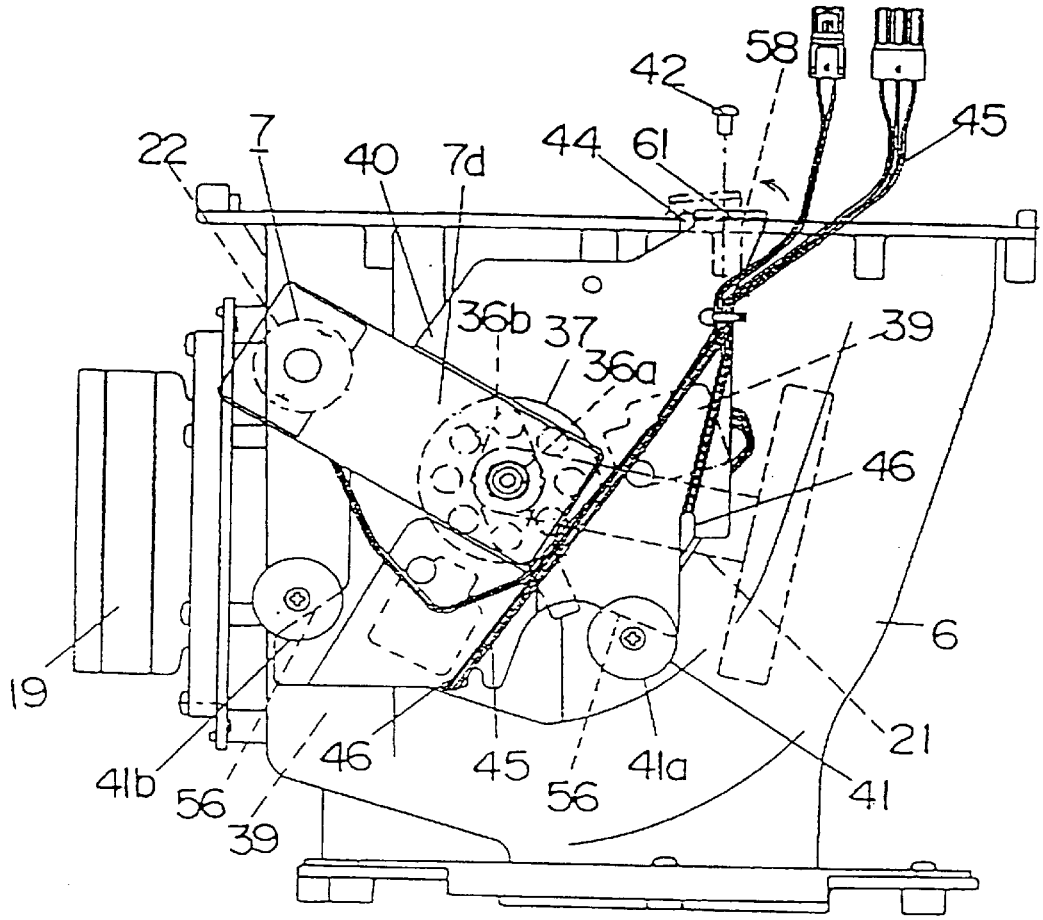
FIG. 14 shows a third sequence for attaching the base plate to the case main body.

Of the front and rear base plate engaging sections 41, stopping section 56 is fitted to one of the base plate engaging sections 41*a* from above while the base plate 40 is allowed to pivot, and stopping section 56 is fitted to the other base plate engaging section 41*b* from below while base plate 40 is allowed to pivot, as shown in FIGS. 12–14. A guide-using slanting portion 57*a*, that guides stopping section 56 of base plate 40 to base plate engaging section 41*a*, is on the upper rib 55*a* of one of the base plate engaging sections 41*a*. A guiding-use slanting portion 57*b* that guides stopping section 56 of base plate 40 to base plate engaging section 41*b* is on a lower rib 55*a* of other base plate engaging section 41*a*.

Figure 15:
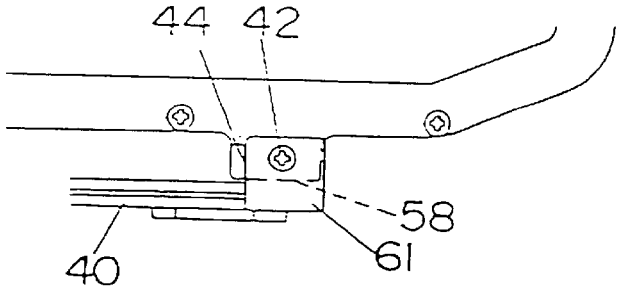
FIG. 15 is a plan view in which a securing member of the base plate is placed on a receiving protrusion formed on the upper end of the case main body, and secured thereon.
Figure 16:
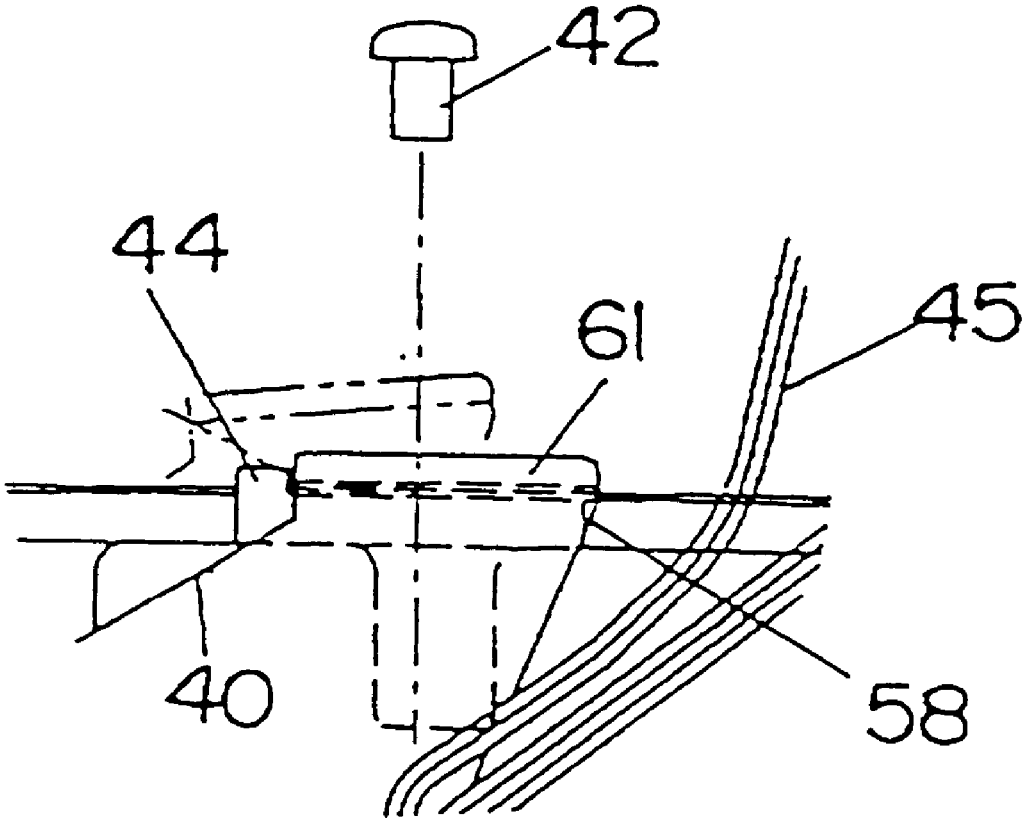
FIG. 16 is a front view in which the securing member of the base plate is placed on the receiving protrusion formed on the upper end of the case main body, and secured thereon.

As shown in FIGS. 11, 15 and 16, a receiving protrusion 58 protrudes from an upper position on the case main body 6. A tapped hole 43 is formed in this receiving protrusion 58. A temporary stopping protrusion 44 that temporarily stops base plate 40 protrudes from the upper face of the receiving protrusion 58.

Figure 17:
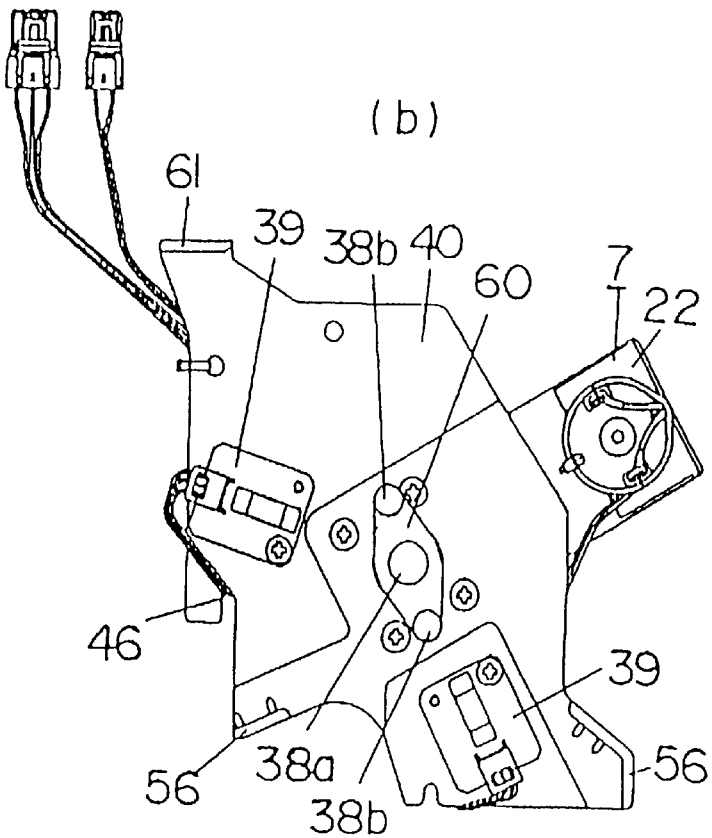
FIG. 17(*a*) is a front view of the base plate.
Figure 17:
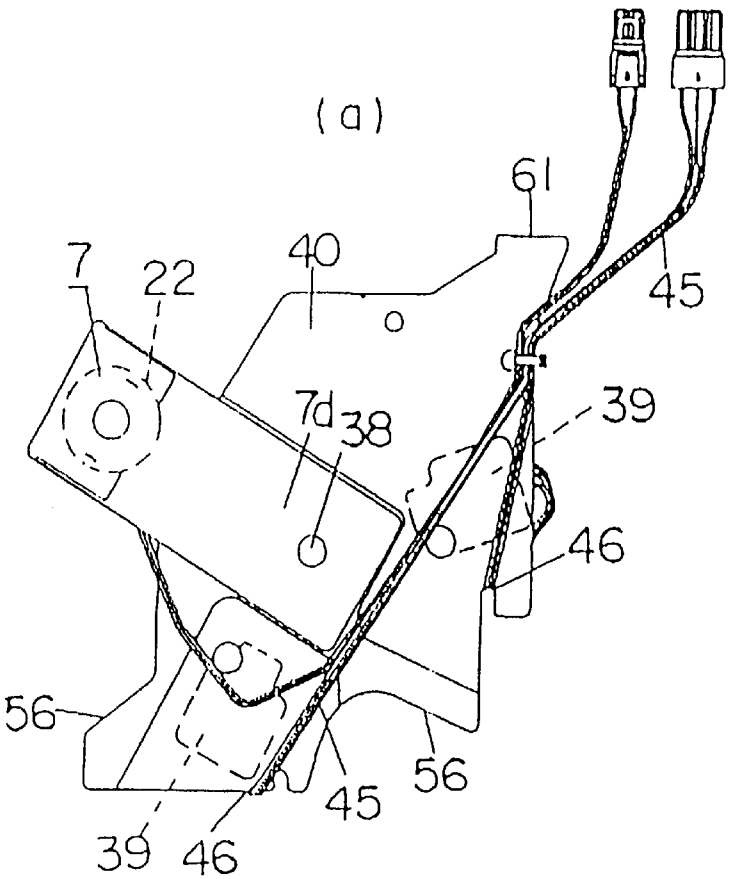

Referring now to FIGS. 17(*a*) and (*b*), trap driving mechanism 7 is installed on the outer face of the base plate 40. A driving output shaft 38 of trap driving mechanism 7 protrudes from the inner face side of base plate 40 at a substantially central portion of base plate 40. A pivotal block 60, which pivots integrally with the driving output shaft 38, is attached to driving output shaft 38. A central section 38*a* (FIG. 18) is formed on the pivotal block 60 coaxially with driving output shaft 38. Sub-stopping sections 38*b* protrude from both of the sides of pivotal block 60. Central stopping section 38*a* has a trapezoidal cone shape that narrows toward the tip. The tip of each sub-stopping section 38*b* also has a trapezoidal cone shape that narrows toward the tip. The length of the protrusion of central stopping section 38*a* is longer than the length of the protrusion of sub-stopping sections 38*b*.

A securing member 61 extends inwardly from the upper portion of base plate 40, and a hole (not shown) is formed in securing member 61. Stopping sections 56 protrude inwardly on a diagonally lower front side and on a diagonally lower rear side of the base plate 40. Two position detection mechanisms 39 are installed at predetermined positions to define an angle centered on the protrusion of the driving output shaft 38. By way of example, a microswitch is used as the position detection mechanism 39, although other suitable devices may of course be used.

As shown in FIG. 18, the tip of central stopping section 38*a* is inserted into central engaging hole 36*a* with the shaft centers of driving output shaft 38 and rotation plate 37 being aligned coaxially. Sub-stopping sections 38*b* are then inserted into arbitrary sub-stopping holes 36*b* independent of the position of the rear end of the trap section 3. Therefore, this arrangement eliminates the need to fit in the lateral direction while confirming the position of a hole having a D-shape that has been conventionally required.

The above insertion process is carried out while the base plate 40 is suspended outside and above case main body 6 with the securing member 61 being held by a user. To perform such an insertion process, the securing member 61 protrudes upwardly from the top end of the case main body 6, as illustrated in FIG. 13.

Next, securing member 61 is pivoted clockwise from the condition shown in FIG. 13, such that base plate 40 pivots integrally with the pivot shaft 35. One of the stopping sections 56 is guided by guiding-use slanting portion 57*a*, and pivots from diagonally above to engage one of the base plate engaging sections 41*a*. The other stopping section 56 is guided by guiding-use slanting portion 57*b*, and pivots from diagonally below to engage the other base plate engaging section 41*b* (see FIG. 14).

When one of the stopping sections 56 engages the base plate engaging section 41, securing member 61 steps over temporary stopping protrusion 44 (FIG. 16) and is placed on receiving protrusion 58. When protrusion 58 is released from the condition shown in FIG. 14, base plate 40 rotates clockwise. Securing member 61 rotates until it contacts temporary stopping protrusion 44. Stopping section 56 is engaged by the base plate engaging section 41 while securing member 61 is placed on receiving protrusion 58. Threaded fastener 42 is then inserted through the hole (not shown) formed in securing member 61 into tapped hole 43 in receiving protrusion 58.

With the above-mentioned arrangement, trap driving mechanism 7 and pivot shaft 35 are coupled (with respect to the attaching process of base plate 40 to case main body 6) independent of the position of the pivotal shaft 35 in the pivoting direction. Threaded fastener 42 is attached only to the upper portion; since the attaching process is carried out by using merely an upward engaging operation, the components are simply connected and installed.

Case main body 6 is installed in the housing space 17 after base plate 40 has been installed on case main body 6. Even after case main body 6 has been installed in housing space 17, the attaching process of base plate 40 can be carried out from above through the gap between the edge of the upper opening of housing space 17 and the outer face of case main body 6.

For maintenance, inspection or repairs, threaded fastener 42 engaging the upper portion of case main body 6 is simply removed by inserting a screw driver through the upper opening of housing space 17. Base plate 40 is slightly moved away from the case main body 6 by manually moving securing member 61 so that central stopping section 38*a* and sub-stopping sections 38*b* are respectively removed from the central stopping hole 36*a* and the arbitrary sub-stopping holes 36*b*, and stopping section 56 is released from base plate engaging section 41. Therefore, in this condition, it is possible to remove base plate 40 by lifting it upward through the gap between the edge of the upper opening of housing space 17 and the outer face of the case main body 6, and consequently to easily carry out the maintenance, inspection or repairing operation of the trap driving mechanism 7 or position detection mechanisms 39 without the need to remove the case main body 6. When maintenance, inspection or repairs are complete, the base plate 40 can be easily reattached without having to remove the case main body 6 as described above.

As illustrated in FIGS. 17(*a*) and (*b*), notched sections in the front and rear sections of the lower edge of the base plate 40 provide a cable turn over stopping section 46. Device case 24 is mounted on the rear upper face of flushing device 4.

The control section is placed inside device case 24. Wiring cables 45 connect a control section to trap driving mechanism 7 and position detection mechanisms 39 installed on the base plate 40. Wiring cables 45 are suspended downward from device case 24 located above, and wrap around a cable turn over stopping section 46 so that they are turned over in a U-shape and connect to position detection mechanisms 39, which are located at a position higher than the cable turn over stopping section 46. Therefore, even if water flows along wiring cables 45, it drains off at the U-shape of the cable turn over stopping section 46, thereby preventing water from reaching the position detection mechanism 39.

Similarly, motor 22 is placed on the upper end of a gear box 7*d*. Wiring cable 45 connected to motor 22 is turned over in a U-shape at the lower corner of gear box 7*d* so that the tip thereof is connected to motor 22. Even if water flows along wiring cables 45, it drains off at the portion turned over in the U-shape on the lower corner of gear box 7*d* of wiring cable 45, thereby preventing it from reaching motor 22.

As described earlier, connection section 19 of the trap section 3 is fitted and connected to the bowl drain outlet 20 formed at the rear end portion of the bowl 1. As illustrated in FIG. 7, widened recess 3*b*' is substantially flush with the inner circumferential face of the cylindrical bowl drain outlet 20. There is thus no step difference between the tip of cylindrical bowl drain outlet 20 and widened recess 3*b*', such that waste drains smoothly.

Figure 10:
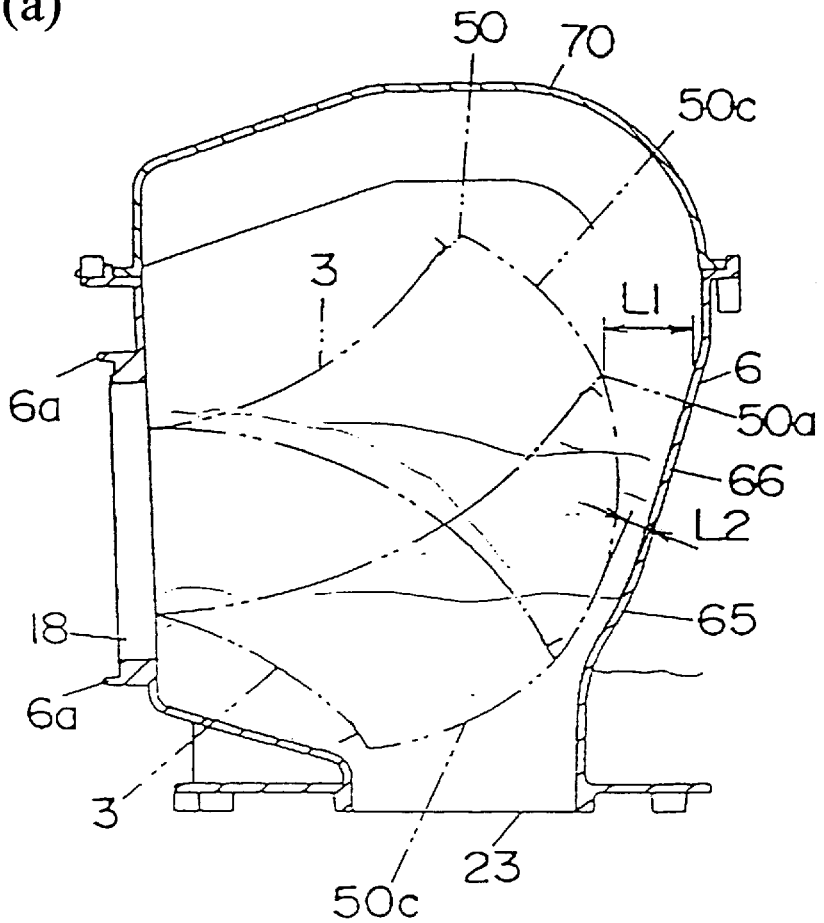
FIG. 10(*a*) shows the relationship between the movement of the rear end of the ring attached to the rear end of the trap section and the rear face of the inside of the case main body.
Figure 10:
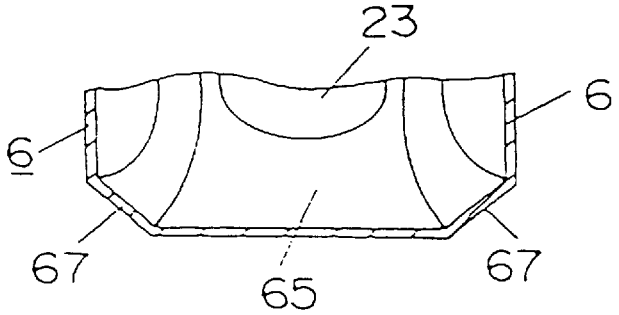

As illustrated in FIG. 10(*a*), a lower portion of the rear face of case main body 6, which faces the rear end of ring 50, has a curved face 65 with an arcuate shape that is substantially identical to the arcuate shaped portion of ring 50 (in a side view). The center of this arcuate shape curved face 65 is substantially coincident with a center of pivot of the trap section 3. Moreover, a slanting face 66, which is inclined from the center portion to the upper portion of the rear face inside case main body 6 (that is, along the upper portion of the arc-shape curved face 65) in a manner so as to extend rearward as it goes upward. When trap section 3 pivots, the gap $L_1$ between portion 50*c* of the ring 50 having the arcuate shape and slanting face 66 widens, while a gap $L_2$ between portion 50*c* of the ring 50 having the arcuate shape and curved face 65 inside case main body 6 narrows.

As illustrated in FIG. 10(*b*), the corner portions formed by the side faces and the rear face inside the case main body 6 are chamfered to define a chamfered portion 67.

The following description will discuss the operation of the present invention.

Figure 1:
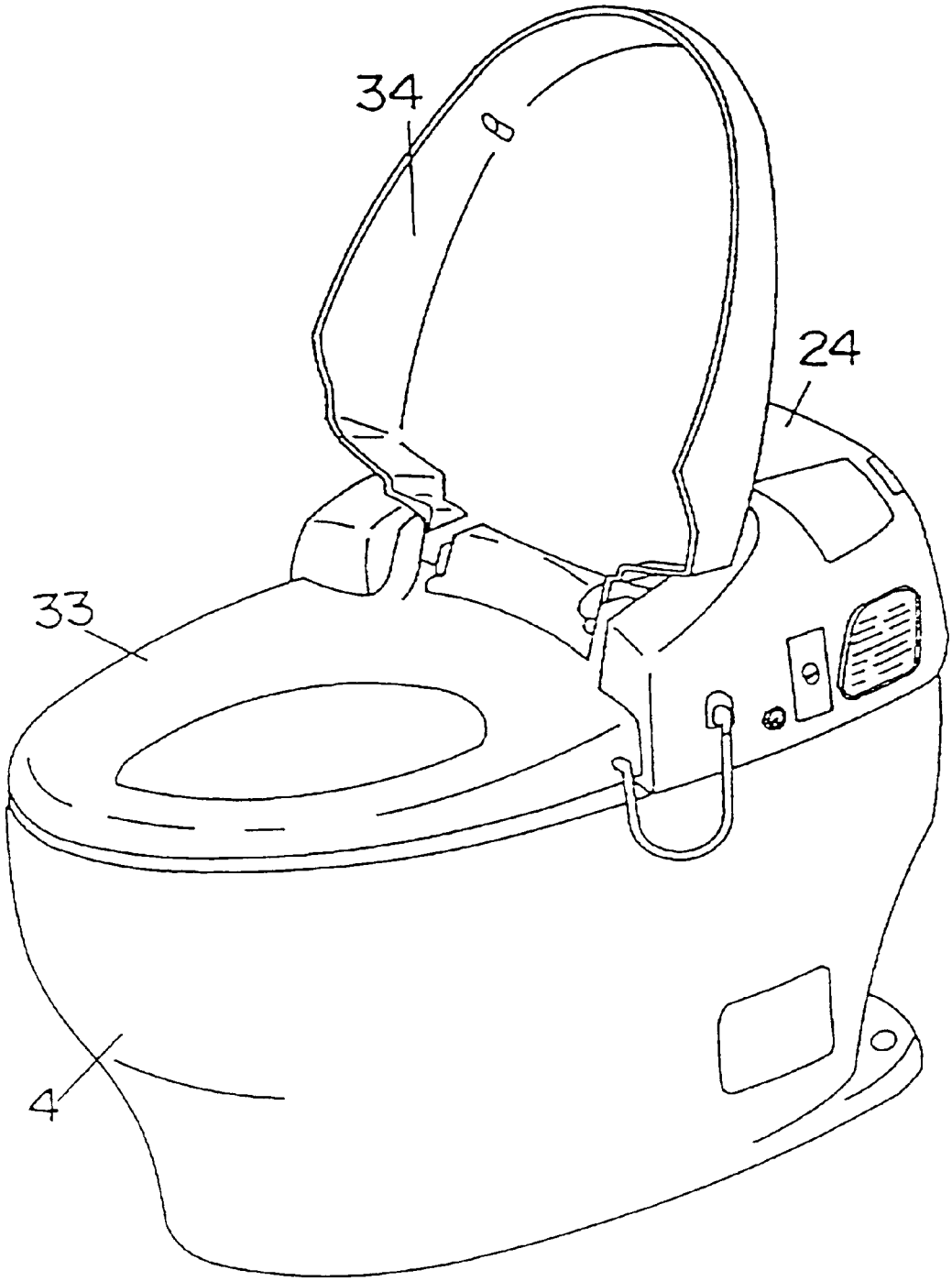
FIG. 1 is a perspective view of a preferred embodiment of the present invention.
Figure 2:
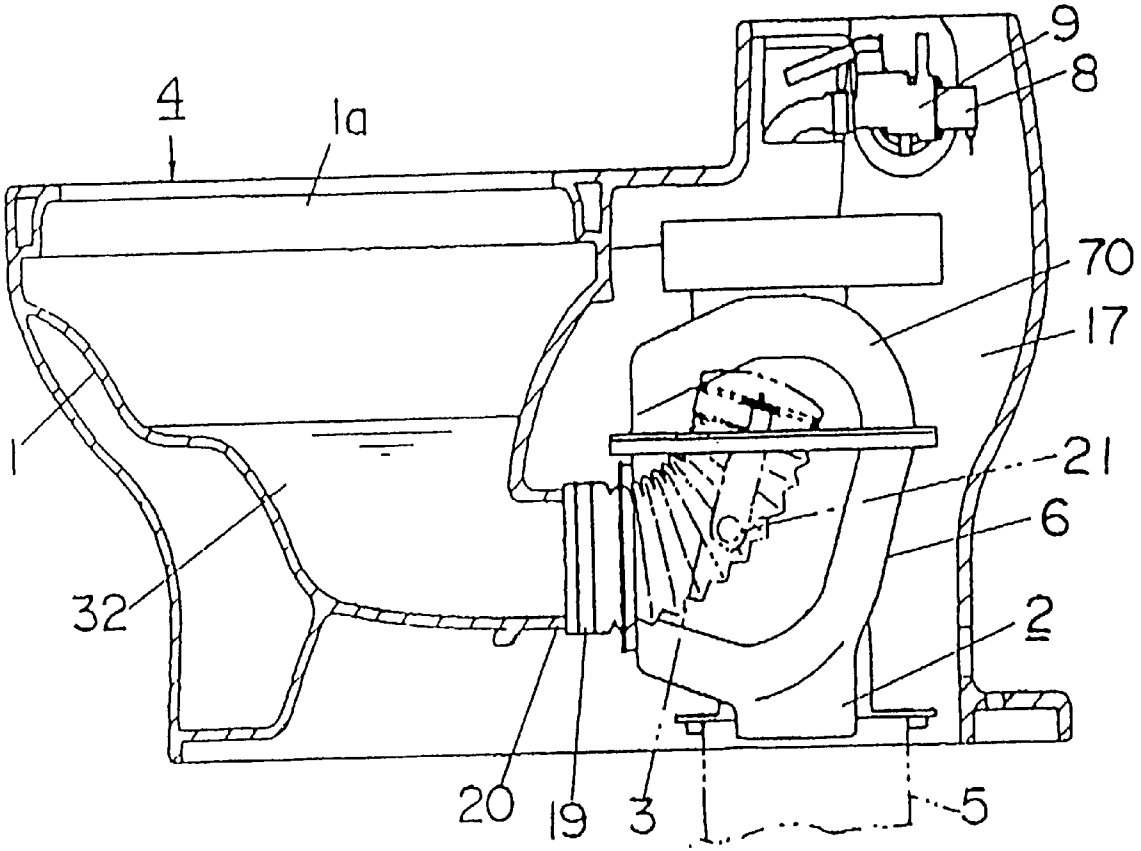
FIG. 2 is a cross-sectional view of FIG. 1.

In the initial state, the rear end of trap section 3 is oriented upward as shown in FIG. 2, where water 32 is held inside bowl 1 and trap section 3. When the washing switch is operated and the on-signal of the washing switch inputs to the control section (not shown), water flows to bowl 1 as indicated by the arrows in FIG. 3 through the water supply path 8 and the rim section. After several seconds (for example, approximately 6 to 8 seconds) trap driving mechanism 7 rotates the rear end of trap section 3 to the lower position (FIG. 3 to FIG. 4 to FIG. 5). The lower position of the rear end of trap section 3 is held for several seconds (for example, approximately three seconds) to drain bowl 1. When bowl 1 is drained, trap driving mechanism 7 rotates trap section 3 to its upper position. Thereafter, water is supplied until bowl 1 and trap section 3 is filled with a predetermined amount of water, whereupon the water-supply 9 is turned off.

The position of protruding member 37*a* is detected by position detection mechanism 39 (FIGS. 6 and 11). Rotation control of trap driving mechanism 7 is carried out by the control section responsive to position detection mechanism 39 so that the rotation angle of rotation plate 37 is controlled to a desired angle.

When the rear end of trap section 3 is in the upper position (FIG. 3), waste overflow from the rear end of trap section 3 discharges downward from the bottom end portion of the rear end, and drains smoothly into the external drain pipe 5 through the gap between trap section 3 and the rear face of case main body 6, without pouring sideways from the sides of the rear end. This prevents waste from flowing on the inner side faces case main body 6 and adhering thereto, or plugging the drain path. In particular, it prevents waste from adhering to the pivot supporting section that supports pivotal member 21. Moreover, when trap section 3 is allowed to pivot, since the gap between the portion 50*c* formed into the arcuate shape in its side view of ring 50 and the upper portion of the rear face inside case main body 6 widens (the gap $L_1$ is widened), waste is further smoothly drained to the external drain pipe 5 through the gap $L_1$ between trap section 3 with its rear end oriented upward and the rear face inside case main body 6.

As illustrated in FIG. 4, during pivotal movement of the trap section 3 to the lower position, the gap $L_2$ narrows, preventing waste from flowing sideways from the respective sides of ring 50, and allowing waste to flow through notched section 50*a* of the bottom end of ring 50 from the time when the rear end of the trap section 3 begins to orient downward and face the external drain pipe 5, and ultimately through the entire opening of the rear end of ring 50 as illustrated in FIG. 5. This prevents waste from flowing sideways from the sides of ring 50 during the pivotal movement, adhering to the inner side faces of case main body 6. In other words, waste first smoothly flows into the external drain pipe 5 from notched section 50*a* of the lower end of the ring 50, and then smoothly drains into external drain pipe 5 through the entire opening of ring 50.

Moreover, since the corner portions formed by the side faces and the rear face of case main body 6 are chamfered as described above, it is possible to avoid waste from depositing at the corner portions formed by the side faces and the rear face of case main body 6, and consequently to allow the waste to smoothly drain into the external drain pipe 5.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The present disclosure relates to subject matter contained in priority Japanese Application No. HEI-11-041024, filed on Feb. 19, 1999, which is herein expressly incorporated by reference in its entirety.

What is claimed is:

1. A flushing device for disposing of human waste, comprising:

a bowl;

a trap section, disposed in a draining path extending from said bowl, having a rear end that pivots between upper and lower positions, a case main body that communicates with an external drain pipe and houses said trap section;

a driving mechanism that moves said trap section between said upper and lower positions;

a water supply mechanism that supplies water to said bowl;

a ring fitted on said rear end of said trap section, said ring having notches on upper and lower sides such that side edges of said ring have an arcuate shape; and said case main body having an arcuate shaped profile that is substantially identical to said arcuate shape of said ring, wherein as said trap section pivots from said upper position to said lower position, a gap between said arcuate shape of said ring and said upper portion of said rear face inside said case main body is larger than a gap between said arcuate shape of said ring and a lower portion of said rear face inside said case main body.

2. The flushing device for disposing of human waste of claim 1, wherein said driving mechanism includes a pivotal member, and said pivotal member is attached to said outer circumferential face of said trap section so that said rear end of said trap section is between said pivotal member and said ring.

3. The flushing device for disposing of human waste of claim 1, wherein a ring positioning section is formed on said rear end of said trap section while a positioning-use section is formed in said ring, such that said ring positioning section and said positioning-use section engage with each other.

4. The flushing device for disposing of human waste of claim 1, wherein said pivotal member includes a pair of pivotal half members having a substantially identical shape, each pivotal half member including a pivotal arm having a first end pivotally mounted on said case main body, and a second end with an integral semicircular section, wherein said semi-circular section of each of said pair of half members connects to each other around said outer circumferential section of said rear end of said trap section.

5. The flushing device for disposing of human waste of claim 4, further comprising:

bearing groove sections, each having an upper opening, in inner faces of respective right and left side portions of said case main body;

a side opening section, having openings upward and sidewards, and narrower than a respective said groove section, formed on a side of each of said bearing groove sections;

a pivot shaft, projecting sideways, formed on one side of said pivotal arm; and a flange formed on said pivot shaft, said flange being pivotally mounted on a respective one of said bearing groove sections, said pivot shaft being pivotally mounted on said side opening section.

6. The flushing device for disposing of human waste of claim 5, further comprising draining notched sections in each said side opening section for draining water remaining inside said bearing groove sections at a lower end of said side opening section.

7. The flushing device for disposing of human waste of claim 6, wherein corner sections of said case main body, defined by said side faces and said rear face of said case main body, are chamfered.

8. The flushing device for disposing of human waste of claim 1, wherein:

said trap section is bellows-shaped, including alternating protrusions and recesses;

a fowardmost one of said protrusions being axially larger than other ones of said protrusions to define a cylindrical connecting section;

a fowardmost one of said recesses behind said connecting section having a larger radius than other ones of said recesses; and said cylindrical connecting section of said trap section being fitted to a cylindrical bowl drain outlet at said rear end of said bowl so that said inner circumferential surface of said cylindrical bowl drain outlet is substantially flush with said widened recess.

9. A flushing device for disposing of human waste, comprising:

a bowl;

a trap section, disposed in a draining path extending from said bowl, having a rear end that pivots between upper and lower positions;

a case main body that communicates with an external drain pipe and houses said trap section;

a water supply mechanism that supplies water to said bowl;

a driving mechanism that moves said trap section between said upper and lower positions, said driving mechanism comprising:

first and second bearing grooves on said case main body;

first and second arms, each having a projecting shaft at a first end pivotally supported in said first and second bearing grooves, respectively, and semicircular portions extending from a second end that join to encircle said rear end of said trap;

said projecting shaft of said first arm having a hole with a non-circular cross section;

a pivot element having a plate and a protrusion that mates with said hole;

said plate having a central hole and a plurality of peripheral holes;

an engaging element that engages said plate at said central hole and at least some of said plurality of peripheral holes; and a motor that rotatably drives said engaging element, which rotatably drives said plate, which rotatable drives said first and second arms, to move said rear end of said trap between said upper and lower positions.

10. The flushing device of claim 9, further comprising a ring mounted on said rear end of said trap, said ring having notches at top and bottom portions thereof to define side portions, such that waste overflow in said trap will flow over at least one of said top and bottom portions before said side portions.

11. The flushing device of claim 9, wherein said engaging element engages two of said plurality of peripheral holes.

12. The flushing device of claim 9, further comprising:

an enclosure having an opening;

said motor, said plate of said pivot element, and said engaging element are disposed outside of said enclosure;

said first and second arms are disposed inside said enclosure; and said projection of said pivoting element passes through said opening.

13. The flushing device of claim 9, further comprising a pivotal block on which said motor and engaging element are mounted.

14. The flushing device for claim 13, further comprising wires for said motor, said wires extending from said motor, around a base of said pivoting block, and up an opposing side of said pivoting block.

15. The flushing device of claim 9, further comprising:

a detection member extending from said plate; and at least one detection apparatus that detects a position of said rear end of said trap based on a position of said detection member.

16. A flushing device for disposing of human waste, comprising:

a bowl having a bowl drain outlet;

a trap section, disposed in a draining path extending from said bowl, having a rear end that pivots between upper and lower positions;

a case main body that communicates with an external drain pipe and houses said trap section;

a water supply mechanism that supplies water to said bowl; and a driving mechanism that moves said trap section between said upper and lower positions; and said trap section comprising:

a plurality of alternative protrusions and recesses to define a bellows shape;

an upstream most one of said protrusions being axially longer than others of said plurality of protrusions to define a connecting section that connects with said bowl drain outlet; and an upstream most one of said recesses having an inner diameter that is substantially identical to an inner diameter of said bowl drain outlet to define a substantially flush connection therebetween.

* * * * *